US011457676B2

(12) United States Patent
Pagan

(10) Patent No.: US 11,457,676 B2
(45) Date of Patent: Oct. 4, 2022

(54) SUPPORTING A PERSONS HEAD WHILE PROVIDING RESPIRATORY PROTECTION

(71) Applicant: Luis Javier Pagan, Dublin, OH (US)

(72) Inventor: Luis Javier Pagan, Dublin, OH (US)

( * ) Notice: Subject to any disclaimer, the term of this patent is extended or adjusted under 35 U.S.C. 154(b) by 337 days.

(21) Appl. No.: 16/875,978

(22) Filed: May 15, 2020

(65) Prior Publication Data

US 2021/0352981 A1 Nov. 18, 2021

(51) Int. Cl.
*A41D 13/11* (2006.01)
*A47G 9/10* (2006.01)
*A47C 7/38* (2006.01)

(52) U.S. Cl.
CPC ..... *A41D 13/1161* (2013.01); *A47C 7/383* (2013.01); *A47G 9/10* (2013.01); *A47G 9/1081* (2013.01); *A41D 2300/322* (2013.01); *A41D 2400/422* (2013.01)

(58) Field of Classification Search
CPC ..... A41D 13/1161; A41D 13/1153; A41D 13/1107; A41D 13/1184; A41D 23/00; A41D 2400/422; A41D 2300/322; A41D 13/11–13/1192; A47G 9/1045; A47G 9/1081; A47G 9/10; A47G 2009/1018; A47G 9/1027; A47G 9/109; A47G 9/1072; A47C 7/383; A47C 7/386; A47C 7/38; A47C 16/00; A61F 9/04; A61F 9/045; A42B 1/018; A42B 1/206; A42B 1/0181; A42B 1/017; A42B 1/24; A42B 1/247
USPC ..... 128/845
See application file for complete search history.

(56) References Cited

U.S. PATENT DOCUMENTS 5,575,009 A * 11/1996 Ryvin ..... A41D 13/1161 2/202
10,863,826 B1 * 12/2020 Schneider ..... A47G 9/1081
D951,676 S * 5/2022 Zheng ..... A41D 13/1161 D6/601
2012/0144590 A1 * 6/2012 Sharp ..... A47C 7/383 5/639
2012/0210516 A1 * 8/2012 Popovic ..... A47G 9/1081 5/636
2014/0007351 A1 * 1/2014 Cohen ..... A47C 7/383 5/639
2014/0041091 A1 * 2/2014 Sternlight ..... A61F 9/04 2/12
2015/0082515 A1 * 3/2015 Parziale ..... A47C 7/383 2/173
2015/0352988 A1 * 12/2015 Knapp ..... B60N 2/882 297/393
2016/0135625 A1 * 5/2016 Cante ..... A47C 7/383 5/636
2020/0253397 A1 * 8/2020 Diaz ..... A47G 9/1081
2021/0298368 A1 * 9/2021 Bussey ..... A47C 31/003
2021/0345702 A1 * 11/2021 Volk ..... A41D 13/11

FOREIGN PATENT DOCUMENTS

JP 2003334131 A * 11/2003 ..... A47C 7/383
JP 2014018624 A * 2/2014
KR 20160139475 A * 12/2016 ..... A47G 9/10
TR 202004411 U5 * 5/2020 ..... A47C 7/383
WO WO-2011137463 A2 * 11/2011 ..... A47C 7/383

* cited by examiner

*Primary Examiner* — Amy Vanatta
(74) *Attorney, Agent, or Firm* — Renner, Otto, Boisselle & Sklar, LLP

(57) ABSTRACT

A device includes a neck pillow, a face mask, and a storage pocket for storing an eye mask in one assembly.

9 Claims, 9 Drawing Sheets

SUPPORTING A PERSONS HEAD WHILE PROVIDING RESPIRATORY PROTECTION

BACKGROUND

Relaxing while travelling by airplane can be difficult. The onset of COVID-19 has made air travel even more of a stressful proposition. Best practice in reducing contagion is for individuals to wear face masks. Individuals seeking to rest in an airplane may struggle to find comfortable positions in airplanes' small seats and while seated in a near upright position. Wearing a mask may make that even more difficult. This is a problem particularly for business travelers who may require adequate sleep operate at full capacity at their destination. To alleviate sleeping problems while traveling, many travelers use portable, supportive neck pillows for upper-body comfort. Typical neck pillows use cushions that wrap around the sides and back of a user's neck, allowing the user to support their head in an upright fashion while seated upright. This prevents neck cricks and pains due to slouching of the user's head while sleeping in the upright position, and further may prevent the user from leaning onto another structure (e.g., cabin walls or window of a plane).

However, the combination of having to wear a face mask in addition to a neck pillow may make resting while traveling by airplane still difficult. For example, the elastic straps commonly used to retain face masks to user's face may be uncomfortable. Even cords that may tie together on the back of the user's head may be uncomfortable because they are usually disposed between the user's head and the airplane seat's cushion. This may prevent travelers from achieving complete R.E.M. sleep.

To help sleep, some individuals carry eye masks while traveling to block light. Eye masks are usually carried separately from the neck support pillow. This added cargo can be cumbersome and may increase the risk of one or both items becoming misplaced and lost.

An effective solution is necessary to address the issue of a head and neck support, while protecting the user from pathogens such as COVID-19 and providing a user with an environment conducive to achieving restful sleep in the confines of an airplane, train, etc. where a user is seated in a generally upright position for an extended period of time.

SUMMARY OF THE INVENTION

The present disclosure provides the combination of a neck pillow, a face mask, and a storage pocket for storing an eye mask in one assembly, addressing this need in the art.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
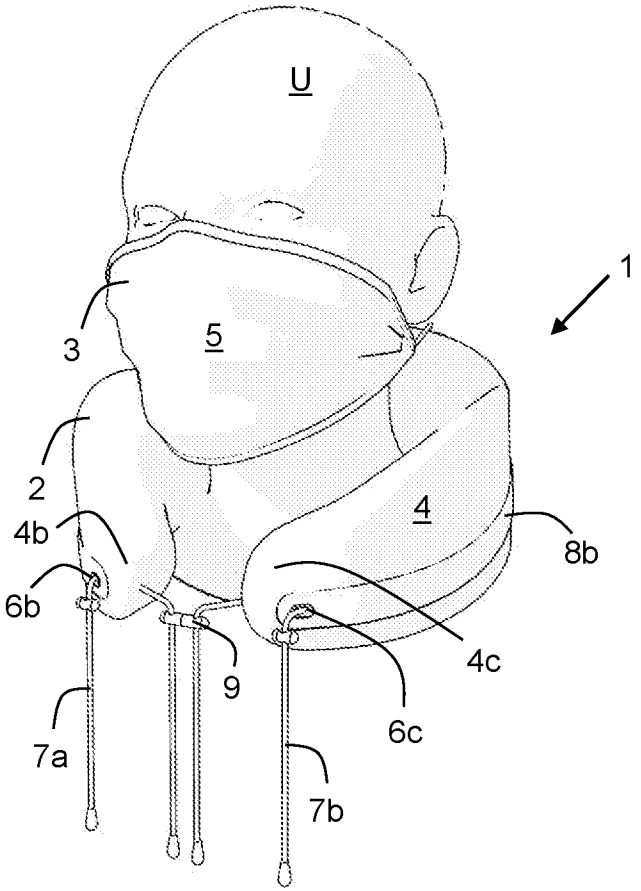
FIG. 1 illustrates a front right perspective view of an exemplary device for supporting a person's head while providing respiratory protection.
Figure 2:
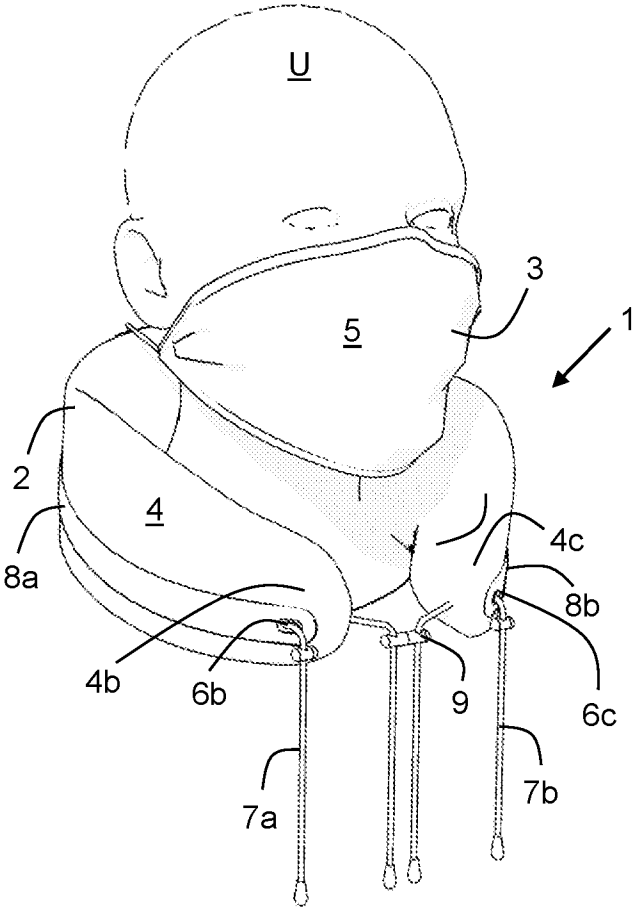
FIG. 2 illustrates a front left perspective view of the exemplary device of FIG. 1.
Figure 3:
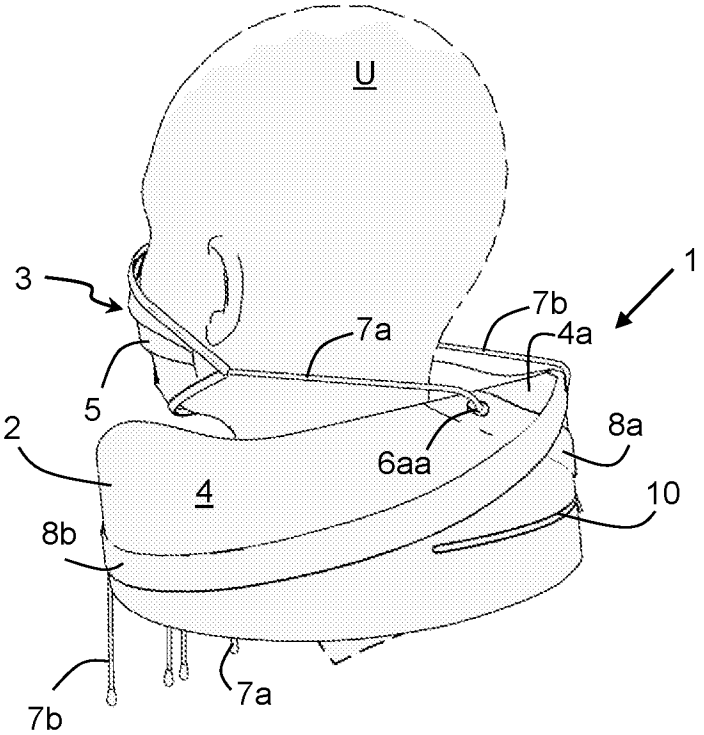
FIG. 3 illustrates a rear right perspective view of the exemplary device of FIG. 1.
Figure 4:
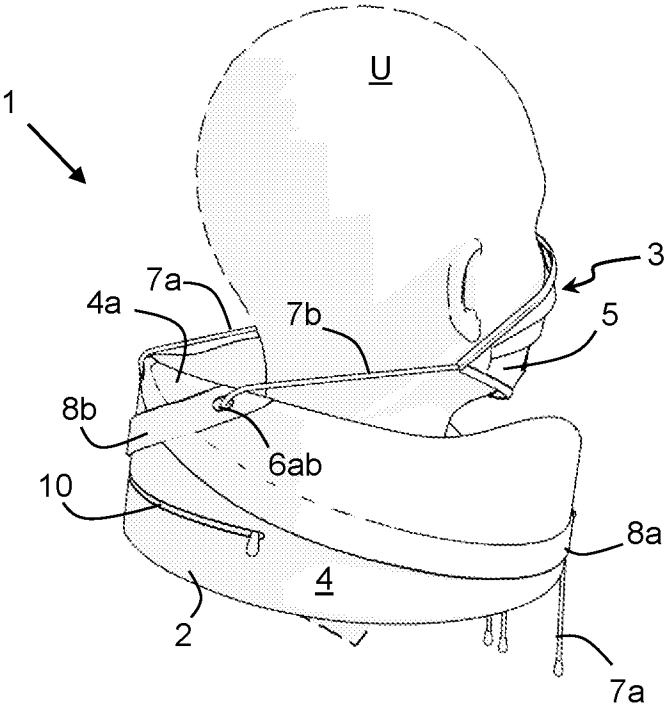
FIG. 4 illustrates a rear left perspective view of the exemplary device of FIG. 1.
Figure 5:
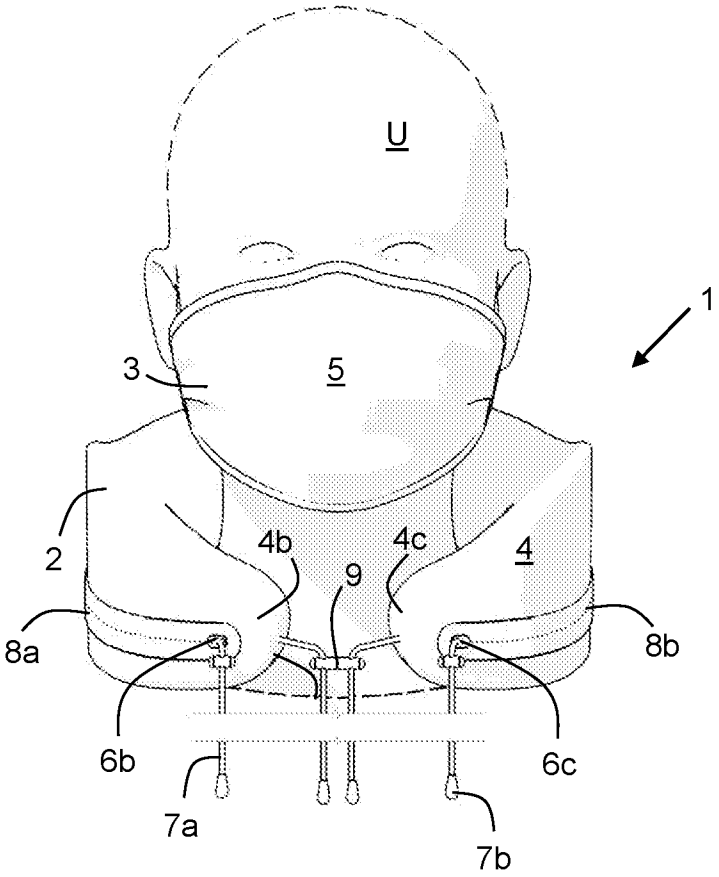
FIG. 5 illustrates a front view of the exemplary device of FIG. 1.
Figure 6:
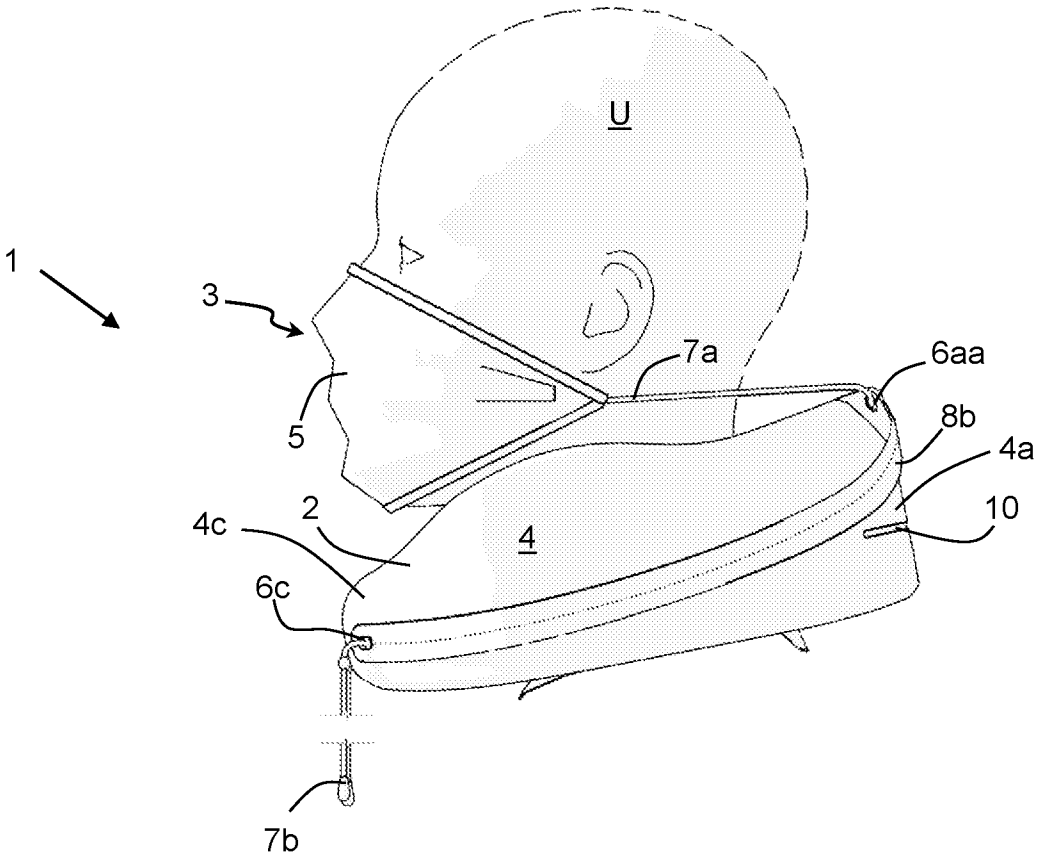
FIG. 6 illustrates a right side view of the exemplary device of FIG. 1.
Figure 7:
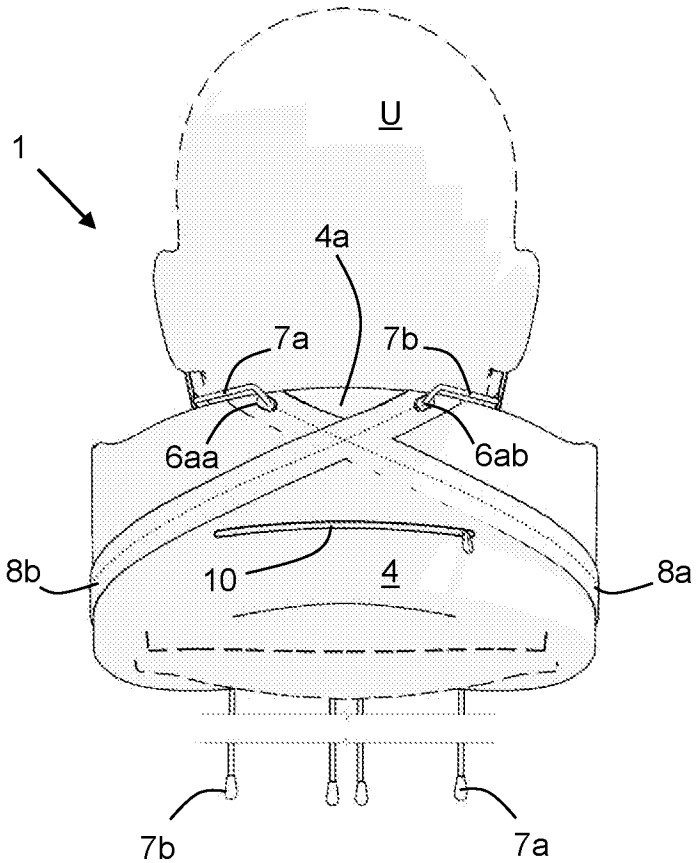
FIG. 7 illustrates a rear view of the exemplary device of FIG. 1.
Figure 8:
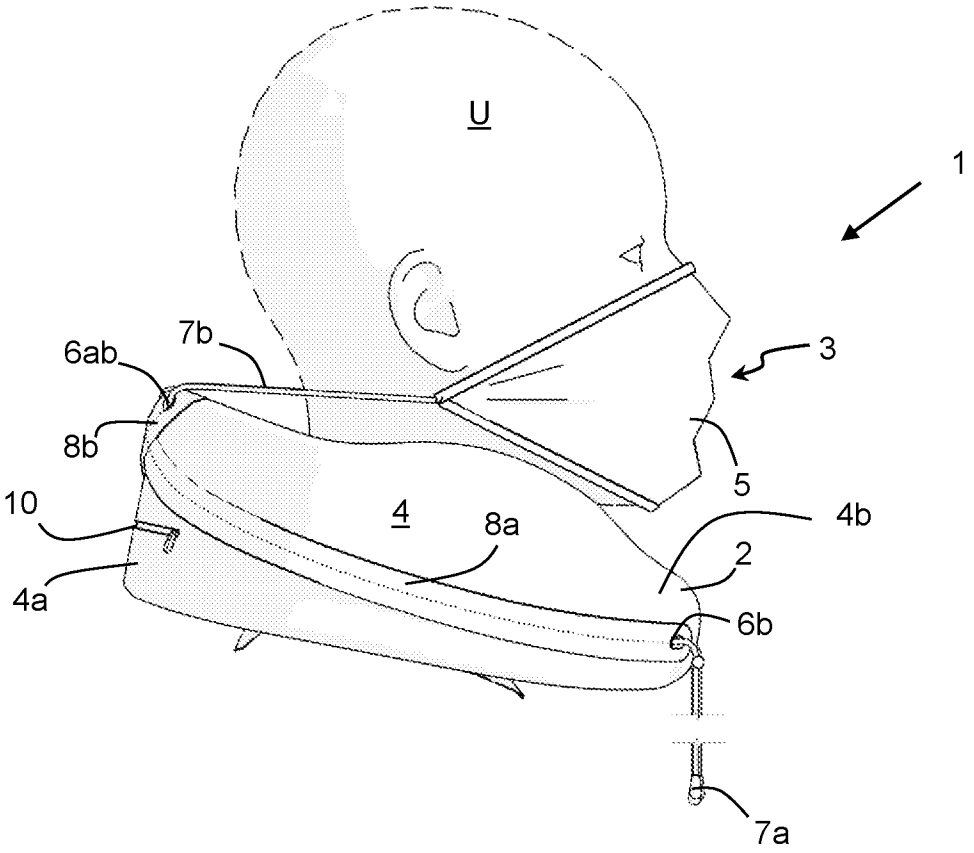
FIG. 8 illustrates a left side view of the exemplary device of FIG. 1.
Figure 9:
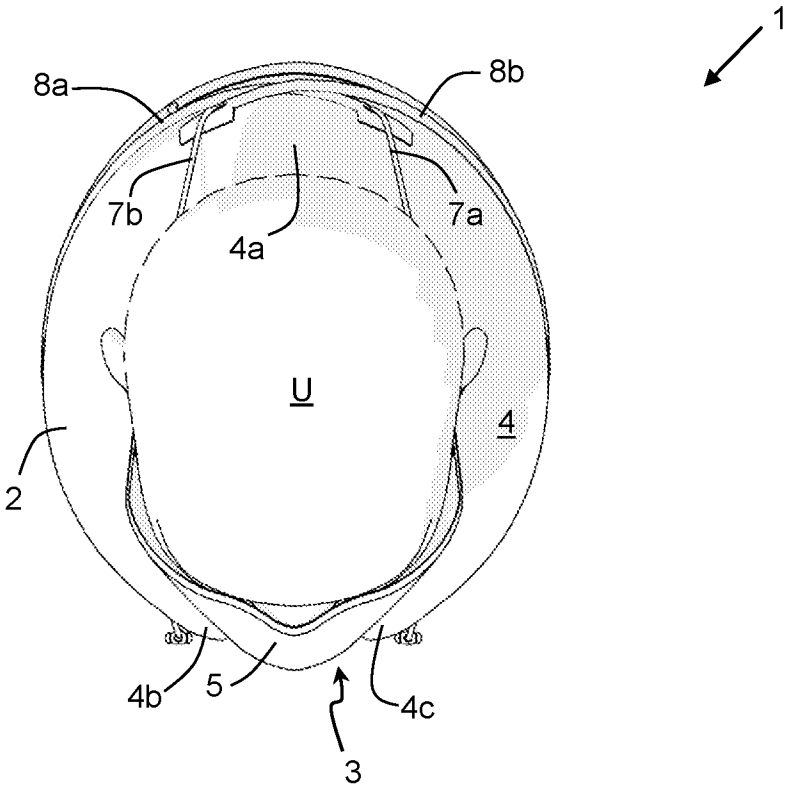
FIG. 9 illustrates a top view of the exemplary device of FIG. 1.

FIGS. 1-9 illustrate an exemplary device 1 in an as-used position for supporting a user's head while providing the user respiratory protection against airborne pathogens and allergens. The device 1 includes a pillow 2 that installs around a neck of the user U and supports the head of the user U in the as-used position shown. The device 1 also includes a face mask 3 that the user U may use to cover her nose and mouth in the as-used position.

The face mask 3 may include a face mask body 5 dimensioned to cover the user's nose and mouth when positioned against the user's face in the as-used position shown. The face mask 3 may also include cord portions 7*a*, 7*b* coupled to the face mask body 5 to, in the as-used position, urge part of the interior surface of the face mask body 5 towards the face of the user U. As best seen in FIGS. 3, 4, 6, and 8, the cords 7*a*, 7*b* are attached to the mask body 5 and pull backwards on the mask body 5. In one embodiment, the cord portions 7*a*, 7*b* may be detachable from the mask body 5.

The body 5 of the face mask 3 may be manufactured from fabric. In one embodiment, the body 5 of the face mask 3 is manufactured from at least two layers of fabric forming a pocket therebetween configured to house a filter. This way the face mask 3 may be used with, for example, an N95 filter or any other filter that may be placed inside the pocket formed by the two layers of fabric. In one embodiment, the face mask 3 includes a malleable nose piece attached to the body 5 to conform to the user's nose and enhance comfort or masking of the user's nose.

The pillow 2 includes a C-shaped body 4 that has a center portion 4*a*, a first end portion 4*b*, and a second end portion 4*c*. The pillow 2 also has openings 6 for the cords 7*a*, 7*b*. In the illustrated embodiment, two of the openings 6*aa* and 6*ab* are disposed adjacent the center portion 4*a*. Another opening 6*b* is disposed adjacent the first end portion 4*b* and another opening 6*c* is disposed adjacent the second end portion 4*c*. The cord portion 7*a* enters the pillow 2 at the opening 6*aa* disposed adjacent the center portion 4*a* and exits the pillow 2 at the opening 6*b* disposed adjacent the first end portion 4*b*. The cord portion 7*b* enters the pillow 2 at the opening 6*ab* disposed adjacent the center portion 4*a* and exits the pillow 2 at the opening 6*c* disposed adjacent the second end portion 4*c*.

In the illustrated embodiment, the pillow 2 includes a strip 8*a* operably connected to the body 4 to form a channel. The opening 6*aa* disposed adjacent the center portion 4*a* is disposed at a first end of the strip 8*a* and the opening 6*b* disposed adjacent the first end portion 4*b* is disposed at a second end of the strip 8*a* such that the cord portion 7*a* enters the pillow 2 at the opening 6*aa* and exits the pillow 2 at the opening 6*b*. Similarly, the opening 6*ab* disposed adjacent the center portion 4*a* is disposed at a first end of the strip 8*b* and the opening 6*c* disposed adjacent the first end portion 4*c* is disposed at a second end of the strip 8*b* such that the cord portion 7*b* enters the pillow 2 at the opening 6*ab* and exits the pillow 2 at the opening 6*c*. This way, the mask 3 may be adjusted and secured using the ends of the cord portions 7*a*, 7*b* at the front of the pillow 2. This is much more convenient and comfortable than using elastic straps or cords that tie on the back of the head of the user U to hold the mask 3 in place.

In one embodiment, the device 1 may include a clasp similar to the clasp 9 shown to retain together the ends of the cord portions 7*a*, 7*b* at the front of the pillow 2. Such a clasp also may be used to simultaneously latch the pillow 2 and the face mask 3 in the as-used position.

The device 1 may also include a pocket 10 built on the body 4 of the pillow 2. The pocket 10 may be a zippered pocket 10 disposed at the center portion 4*a* (or somewhere else) on the pillow 2 to safely keep items such as an eye mask the user U may use to block light and sleep safely stored while traveling in a plane.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A device for supporting a user's head while providing the user respiratory protection against airborne pathogens and allergens, comprising:

a face mask configured to cover a portion of the user's face when worn in an as-used position, the face mask comprising: a face mask body dimensioned to cover the user's nose and mouth when positioned against the user's face in an as-used position, and one or more cord portions coupled to the face mask body to, in the as-used position, urge an interior surface of the face mask body towards the user's face; and a pillow configured to install around a neck of the user and to support the head of the user in the as-used position and comprising a C-shaped body having a center portion, a first end portion, and a second end portion, the pillow having openings, at least one of the openings disposed adjacent the center portion, at least one of the openings disposed adjacent the first end portion, and at least one of the openings disposed adjacent the second end portion, the one or more cord portions entering the pillow at the at least one of the openings disposed adjacent the center portion and exiting the pillow at the at least one of the openings disposed adjacent the first end portion and the at least one of the openings disposed adjacent the second end portion.

2. The device of claim 1, wherein the pillow includes a strip operably connected to the body to form a channel, the at least one of the openings disposed adjacent the center portion disposed at a first end of the channel and the at least one of the openings disposed adjacent the first end portion disposed at a second end of the channel such that a portion of the one or more cord portions entering the pillow at the at least one of the openings disposed adjacent the center portion and exiting the pillow at the at least one of the openings disposed adjacent the first end portion resides within the channel.

3. The device of claim 1, wherein the pillow includes a first strip and a second strip operably connected to the body to form a first channel and a second channel, respectively, a first one of the at least one of the openings disposed adjacent the center portion disposed at a first end of the first channel and the at least one of the openings disposed adjacent the first end portion disposed at a second end of the first channel such that a first portion of the one or more cord portions entering the pillow at the first one at least one of the openings disposed adjacent the center portion and exiting the pillow at the of the at least one of the openings disposed adjacent the first end portion resides within the first channel and a second one of the at least one of the openings disposed adjacent the center portion disposed at a first end of the second channel and the at least one of the openings disposed adjacent the second end portion disposed at a second end of the second channel such that a second portion of the one or more cord portions entering the pillow at the second one of the at least one of the openings disposed adjacent the center portion and exiting the pillow at the at least one of the openings disposed adjacent the second end portion resides within the second channel.

4. The device of claim 1, wherein the one or more cord portions are releasably coupled to the face mask's body.

5. The device of claim 1, comprising a clasp configured to retain together a first portion of the one or more cord portions exiting the pillow at the at least one of the openings disposed adjacent the first end portion and a second portion of one or more cord portions exiting the pillow at the at least one of the openings disposed adjacent the second end portion to simultaneously latch the face mask and the pillow in the as-used position.

6. The device of claim 1, wherein the face mask's body includes a malleable nose piece to accommodate the user's nose.

7. The device of claim 1, wherein the face mask's body is manufactured from fabric.

8. The device of claim 1, wherein the face mask's body is manufactured from two layers of fabric forming a pocket configured to house a filter.

9. The device of claim 1, wherein the pillow's body has built thereon a zippered pocket disposed at the center portion.

* * * * *